US005231900A

United States Patent [19]

Deri

[11] Patent Number: 5,231,900

[45] Date of Patent: Aug. 3, 1993

[54] AUTOMATIC SCREW DRIVING MECHANISM

[76] Inventor: Yosef Deri, 321A Crowells Rd., Highland Park, N.J. 08904

[21] Appl. No.: 921,060

[22] Filed: Jul. 29, 1992

[51] Int. Cl.[5] ..... B25B 23/06

[52] U.S. Cl. ..... 81/57.37; 81/434

[58] Field of Search ..... 81/57.37, 433, 434, 81/435

[56] References Cited

U.S. PATENT DOCUMENTS

| | | | |
|---|---|---|---|
| 1,815,594 | 7/1931 | Shaw et al. | 81/57.37 |
| 2,878,700 | 3/1959 | Reynolds | 81/57.37 |
| 3,891,014 | 6/1975 | Gunn | 81/57.37 |
| 4,018,254 | 4/1977 | DeCaro | 81/57.37 |
| 4,367,837 | 1/1983 | Manino | 81/434 X |
| 4,466,555 | 8/1984 | Yarnitsky et al. | 81/57.37 |
| 4,625,597 | 12/1986 | Cast | 81/57.37 |
| 4,998,452 | 3/1991 | Blum | 81/57.37 |

*Primary Examiner*—James G. Smith

*Attorney, Agent, or Firm*—Henry Schanzer

[57] ABSTRACT

A mechanism for providing a conventional drill with an automatic screw feeding capability comprises an elongated sleeve formed from a tubular wall defining an elongated passageway, a screw driving rod slidably and rotatably disposed within the passageway, and a dependent, hollow skirt surrounding an opening through the wall providing access to the passageway. A magazine containing a spring urged stack of screws, each disposed within a stacking cylinder, is inserted into the skirt for disposing a top end of the magazine within the passageway. The magazine top end includes a slot in alignment with the rod axis allowing removal of a cylinder jacketed screw from the magazine by the rod upon forward movement thereof. In use, the rod rear end is engaged within a drill chuck and movement of the rod relative to the sleeve is obtained by relative movement between the drill, held in one hand by a user, and the sleeve mounted magazine, held in the user's other hand.

9 Claims, 4 Drawing Sheets

AUTOMATIC SCREW DRIVING MECHANISM

BACKGROUND OF THE INVENTION

This invention relates to screw driving apparatus, e.g., drills, and particularly to a mechanism for attachment to a conventional drill for providing it with an automatic screw feeding capability.

Screw driving apparatus, including means for automatically feeding screws to be screwed into a workpiece, are known, see for example, U.S. Pat. Nos. 5,027,679, 4,625,597, 5,031,489, 5,083,483, 4,047,611 and 4,146,071, the subject matter of which are incorporated herein by reference. These apparatus, however, are relatively complex and expensive and have a limited market appeal, e.g., to professional craftsmen. A need exists, therefore, for a relatively simple and inexpensive mechanism or kit which can be used with a conventional drill for providing it with an automatic screw feeding capability. This need is satisfied by this invention.

SUMMARY OF THE INVENTION

An automatic screw feeding mechanism for use with a conventional drill comprises an elongated, hollow sleeve including an elongated screw driving rod slidably received within an elongated passageway through the sleeve. The rod has a front end for operative engagement with a screw to be driven and a rear end for operative engagement with the rotatable chuck of a conventional drill. The sleeve includes a hollow, dependent skirt surrounding an opening through a wall of the sleeve and providing access to the sleeve passageway. A screw containing magazine having a screw dispensing top end is inserted into the skirt for automatically disposing a screw within the sleeve passageway when the screw driving rod therewithin has been moved rearwardly of the skirt opening.

A kit for providing a conventional drill with an automatic screw feeding capability includes the aforementioned mechanism parts and a supply of small hollow cylinders for receipt of individual screws for parallel stacking of the screws within the magazine.

DESCRIPTION OF PREFERRED EMBODIMENTS

Figure 1:
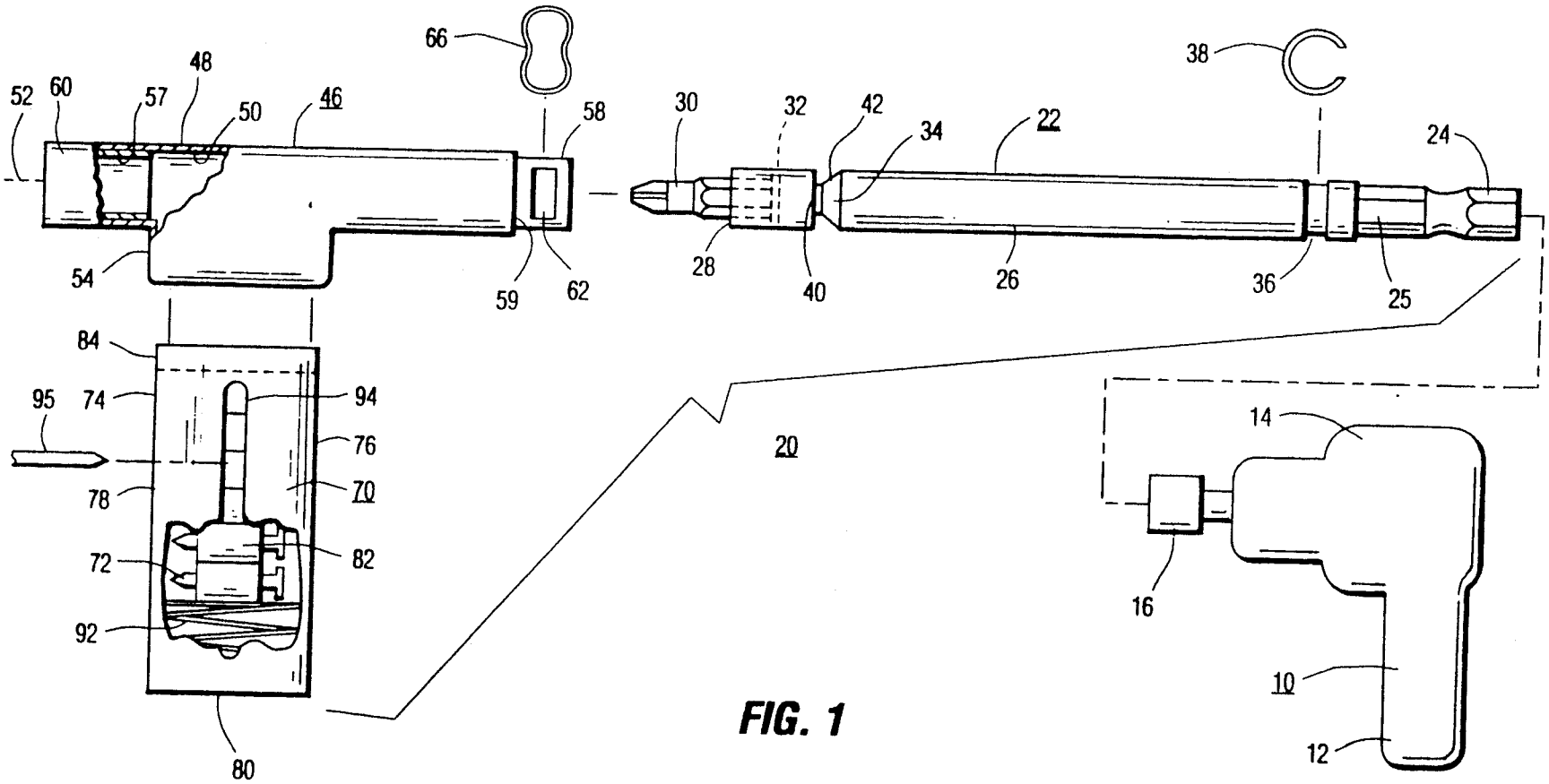
FIG. 1 is an exploded, side view of a mechanism according to this invention and showing a drill with which the mechanism can be used.

FIG. 1 shows a conventional power drill 10 of the type with which the present invention has utility. As known, the drill 10 includes a hand grip 12, a housing 14 containing an electric motor, and an expandable chuck 16 for clampingly engaging an end of a drill bit used for drivingly engaging the head end of a screw.

A mechanism 20 for providing the drill with an automatic screw feeding capability is shown attachable to the drill by means of an elongated screw driving rod 22.

Except as hereinafter described, the rod 22 can be similar to conventional rods of the type used when longer than usual drill bits are required for access to recessed work areas. Thus, as known, the rod 22 can comprise a solid rear end 24 having a round or hexagonal cross-section for conventional mating within an expandable drill chuck, and a hollow cylinder 26 of circular cross section terminating in a front opening 28 having a hexagonal cross-section for receipt of a conventional, short length drill bit 30. Conventionally, a transversely extending magnet 32 is disposed within the cylinder 26 a short distance rearwardly of the front opening 28 providing a simple means for releasably retaining the drill bit 30 within the rod 22. Thus, different drill bits for different screws can be interchangeably used.

In accordance with one embodiment of this invention, the rod 22 is provided with two circumferentially extending grooves 34 and 36 adjacent to the front 28 and rear 25 ends, respectively of the rod cylinder 26. Received within the rear groove 36 is a C-ring 38 the purpose of which is to provide a circumferential flange having an outer diameter slightly greater than that of the rod cylinder 26.

The front end groove 34 has a front side wall 40 (see also FIG. 3) which is perpendicular to the longitudinal axis of the cylinder 26 and a rear wall 42 which slopes rearwardly from the bottom of the groove 34.

The purpose of the two grooves is described hereinafter.

Mating with the rod 22 is an elongated sleeve 46 comprising an elongated tubular wall 48 defining an elongated passageway 50 having a central axis 52, and a dependent, hollow skirt 54 disposed around an opening 56 (also, FIGS. 2 and 4) through the sleeve wall 48 and providing access to the sleeve passageway 50.

Disposed within the sleeve passageway 50 are two axially aligned hollow tubings 57 and 58 disposed on either side of the opening 56 through the sleeve wall 48. The tubing 58 extends slightly rearwardly of the rear end 59 of the sleeve wall 48.

The rod 22 is slidably and rotatably received within the two tubings 57 and 58 and is movable with respect to the sleeve 46 from a position (FIG. 2) where the front end 28 of the rod 22 is slightly forward of the front end 60 of the sleeve to a position (FIG. 3) where the rod front end including a drill bit 30 mounted thereon are disposed rearwardly of the sleeve skirt 54.

Means are provided for restricting the movement of the rod 22 relative to the sleeve 46 within the above-described range of movements. The flange provided by the C-ring 38 (FIG. 2) in the groove 36 has an outer diameter slightly greater than the diameter of the tubing 58, hence engagement of the C-ring 38 with the end surface 61 of the tubing 58 prevents further forward movement of the rod 22 relative to the sleeve 46.

Figure 2:
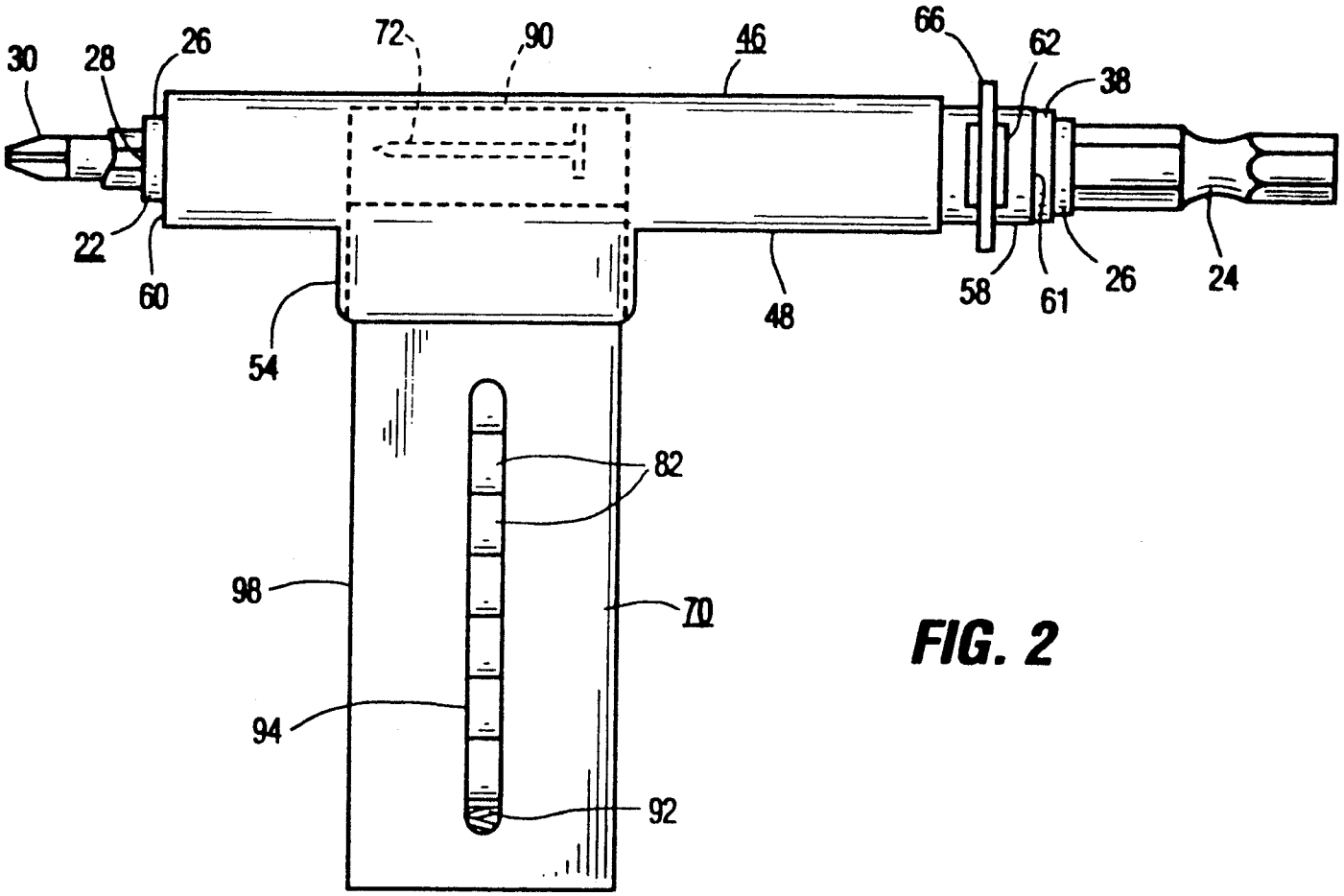
FIG. 2 is a side view of an assembled mechanism.
Figure 3:
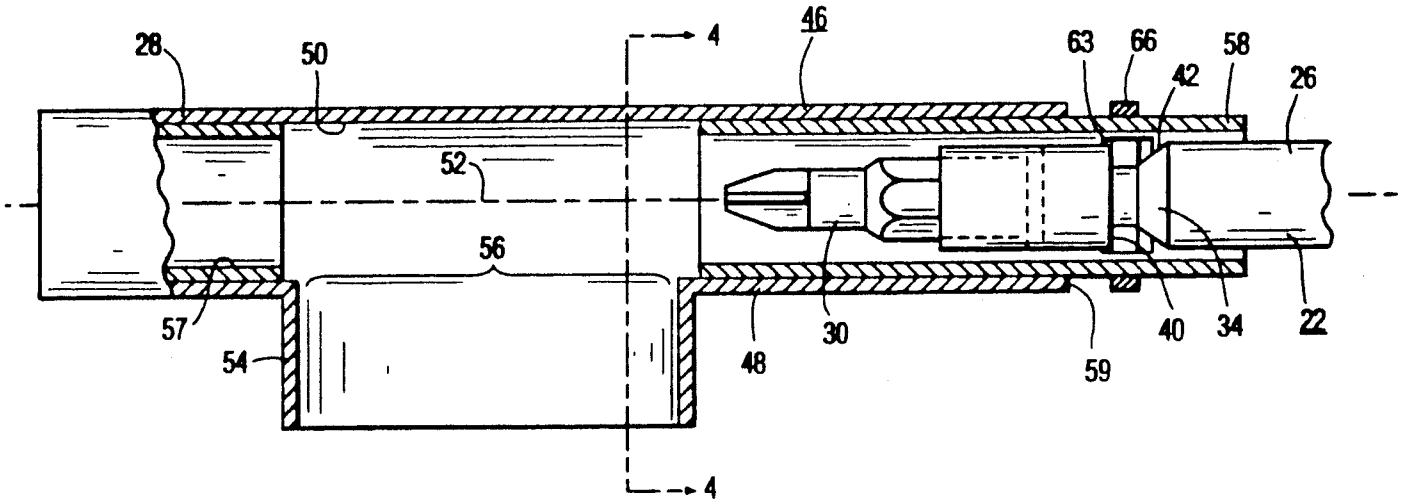
FIG. 3 is a side view, in cross-section, of a portion of the mechansim showing the rear-most position of the screw to any rod relative to the sleeve.
Figure 5:
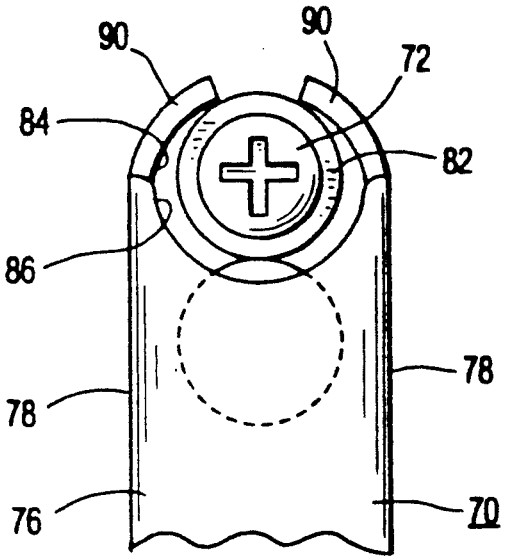
FIG. 5 is an end view of the upper portion of the magazine.

For limiting the rearward movement of the rod 22 relative to the sleeve 46, the portion of the tubing 58 extending beyond the sleeve wall 48 is provided with two circumferentially extending slots 62 and 63. One of the slots 62 is shown in FIGS. 1 and 2, the other slot 63 is shown in FIG. 3. The two slots 62 lie in a common radial plane and are oppositely disposed to one another. A resiliently expandable wire loop 66 is disposed around the tubing 58 and within the two slots and is of sufficient tightness to follow the shortest possible path around the tubing 58 via the slots 62 and 63. In known manner, the cylindrical portion 26 of the rod 22 slides readily past the loop 66 inside surface, but the loop snaps into the groove 34 and against the radially extending front wall 40 thereof to prevent further rearward movement of the rod while being slidable along the sloped rear wall 42 for allowing forward movement of the rod.

Other means for limiting the range of movements of the rod 22 relative 46 to the sleeve can be used.

A magazine 70 is provided for storage of screws 72 for sequential and automatic insertion into the passageway 50 of the sleeve and into the path of movement of the rod 22 therein.

The magazine 70 is an elongated, box-like structure having, relative to the sleeve 46, front 74, rear 76, side 78 and bottom 80 walls.

Figure 4:
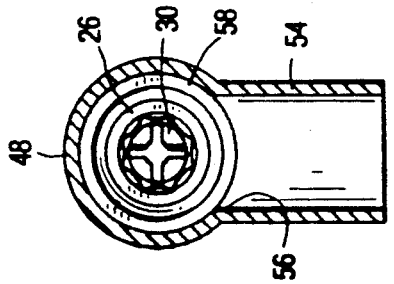
FIG. 4 is a view along the line 4 of FIG. 3.

Screws 72, within stacking cylinders 82 to be described, are stacked horizontally within the magazine 70 and a horizontal front to rear extending slot 84 (see also, FIG. 4) is provided at the top of the magazine allowing horizontal removal of the topmost screw 72, and its stacking cylinder 82, from the magazine. As shown in FIG. 4, the magazine upper slot 84 is defined by a semicircular opening 86 through the rear 76 wall of the magazine and a similar opening in the front wall 74, and by inwardly curving top ends 90 of the magazine side walls 78. The inside diameter of the slots 84 is greater than its outside diameter of the stacking cylinders 82.

Figure 6:
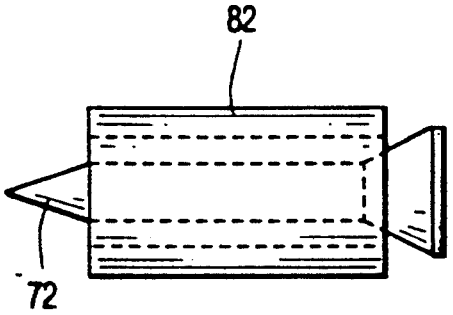
FIG. 6 is a side view of a screw received within a stacking cylinder.

The purpose of the screw cylinders 82 is to provide means for controlling the orientation of the screws. To this end. the cylinders 82 (FIG. 6) have an inside diameter slightly greater than that of the threaded shanks of the screws 72 and an outside diameter slightly greater than that of the screw heads. Thus, within the magazine (FIGS. 1 and 4), only the cylinders 82 engage one another and horizontal stacking is obtained. For reasons described hereinafter, the cylinders have a length somewhat less than that of the screws, so that the forward ends of the screws protrude from the cylinders, and the cylinders are preferably made of a brittle material, e.g., glass or a brittle plastic.

A compressible spring 92 is disposed within the magazine for engaging the bottom-most cylinder jacketed screw and urging the stack of screws upwardly and into the top end of the magazine. The top-most screw in the magazine stack is retained within the magazine by the inwardly curved magazine side walls 90 (which can form a continuous magazine top wall) while the screw head is exposed through the slot rear opening 86.

For ease of loading the cylinder jacketed screws into the magazine, a vertically extending slot 94 is provided through one of the side walls by means of which a narrow tool 95 (FIG.1) can be inserted into the magazine and into contact with the top end of the spring 92 for compressing the spring into the bottom of the magazine. Cylinder jacketed screws are then inserted, one by one, into the magazine through the top slot 84. When the magazine is loaded, the spring compressing tool is removed to allow the spring to compress the stack of screws towards the magazine top end.

The upper portion of the magazine 70 fits relatively snugly within the sleeve skirt 54 and is held in place therein by friction. Alternatively, known resilient detente means can be used for releasingly retaining the magazine within the skirt 54.

To assemble the magazine 70 to the sleeve 46, a drill bit 30 is first mounted on the front end of the screw driving rod 22, the rod 22 is moved rearwardly of the sleeve skirt 54 to clear the passageway 50 over the skirt (FIG. 4), and the upper end 96 of the magazine is inserted into the skirt until the inwardly curved sections 90 of the magazine side walls 78 engage the circular wall of the passageway 50 with the horizontal axis of the magazine upper slot 84 being in alignment with the passageway axis. Also, the top-most jacketed screw 72 in the magazine is similarly axially aligned within the sleeve passageway.

The assembled and loaded mechanism 20 is used with a drill by clamping the rear end 24 of the rod 22 within the chuck 16 of a drill 10 (FIG.1), and, while holding the portion 98 (FIG. 2) of the magazine 70 extending outwardly from the shirt 54 in one hand and the grip of the drill in the other, moving the drill towards the sleeve for advancing the rod 22, and the drill bit 30 therein, into contact with the rear end of the magazine top-most screw which is, as previously explained, also disposed within the sleeve passageway. Continued forward movement of the rod pushes the top-most jacketed screw outwardly of the magazine and forwardly of the sleeve until the leading end of the screw begins to merge from the sleeve forward end 58. By turning on the drill and pressing the screw end against a workpiece, the drill bit seats itself within the recess in the screw head and drives the screw into the workpiece.

To this point, the screw being driven is disposed within a stacking cylinder 82. A sufficient length of the screw protrudes from the cylinder to allow penetration of the screw into the workpiece. With continued screwing of the screw into the workpiece, the cylinder 82 becomes compressed between the workpiece surface and the rotating screw head and, owing to the brittleness of the cylinder, the cylinder abruptly shatters and completely falls away from the screw without brushing or other action by the user. Thus, no interruption in the screwing process is required.

When the first screw has been screwed into the workpiece, the drill 10 is moved rearwardly of the sleeve 46 for withdrawing the rod 22 and the drill bit thereon rearwardly of the magazine slot 84, whereupon the next-in-line jacketed screw is immediately and automatically forced into the magazine slot to be next used.

A commercial feature of the invention is that, in addition to providing an automatic screw feeding capability for conventional drills, the use of the invention creates a new market for the stacking cylinders 82 used with the screws. Thus, a kit can be marketed for the aforedescribed automatic screw feeding mechanism 10 including different size sleeves 46 for use with different size screws, each sleeve containing a screw driving rod 22 in assembled relationship therewith, different size magazines 70, a magazine spring depressor 95, and an assortment of cylinders 82 for use with different size screws. Also, the kit can contain an assortment of drill bits and screws for use with the screw feeding mechanism.

Further, instead of refilling the magazines with screws, pre-filled disposable magazines can be used. The disposable magazines can be sold separately or as part of the kits.

In another embodiment of the invention, instead of the tool 95 for compressing the spring 92, a short extension from the upper portion of the spring can extend outwardly of the slot 94, whereby the spring can be compressed by pressing downwardly on the extension.

Note, the resilient detent means referred to on page 6, can be a clip or some other mechanical means to hold the magazine releasably secured to the skirt.

What is claimed is:

1. An automatic screw feeding mechanism for use with a drill, the mechanism comprising an elongated, hollow sleeve including a tubular wall defining an elongated passageway having front and rear ends and having a central axis, an elongated screw driving rod slidably and rotatably disposed within said passageway, said rod having a front end for operative engagement with a screw to be driven and a rear end for operative engagement with a drill, a hollow, tubular skirt dependent from said sleeve, said skirt being attached to said sleeve in surrounding relationship with an opening in said tubular wall, said opening providing access through said skirt to said passageway, and a magazine for containing screws having an end portion insertable into said skirt and into said passageway for disposing a screw within said end portion in axial alignment within said passageway, said end portion having a port means allowing entry of said rod into and through said end portion for advancing a screw within said end portion outwardly of said magazine and towards the front end of said passageway, said magazine including means for biasing screws contained within said magazine towards said end portion thereof, said magazine having an outer wall defining a space within the magazine for containing screws and enclosing said space to an extent allowing grasping of said outer wall by a hand of an operator during use of the mechanism with a drill without contact between the operator's hand and screws within said space, said magazine serving as a handle during such use, and said skirt being positioned rearwardly of the front end of said passageway.

2. A mechanism according to claim 1 wherein said skirt is positioned intermediate the ends of said passageway, and the mechanism further included tubular members disposed within said passageway on either side of the opening and extending from said opening rearwardly and forwardly thereof, respectively, and serving as bearings for said rod within said passageway.

3. A mechanism according to claim 1 including means for retaining said rod within said sleeve and for limiting movement of the rod axially of said passageway within a preselected range of movements.

4. A mechanism according to claim 3 wherein said rod includes means for releasingly securing a drill bit to said front end thereof, and said range of movements includes a front terminal position wherein the front end of said rod projects forwardly of the front end of said passageway, and a rear terminal position wherein the front end of said rod as well as a drill bit secured thereon are disposed rearwardly of the opening through said tubular wall and rearwardly of said end portion of said magazine disposed within said passageway.

5. A kit for providing a screw driving drill with an automatic screw feeding capability, the kit comprising an elongated, hollow sleeve including a tubular wall defining an elongated passageway having front and rear ends and having a central axis, a hollow, tubular skirt dependent from said sleeve, said skirt being attached to said sleeve in surrounding relationship with an opening in said tubular wall, said opening providing access through said skirt to said passageway, an elongated screw driving rod for being slidably and rotatably received within said passageway, said rod having a front end for operative engagement with a screw to be driven and a rear end for operative engagement with a screw driving drill, and a magazine for containing screws to be individually fed into said passageway for operative engagement with said rod, said magazine having an end portion for insertion through said skirt and into said passageway for disposing a screw within said end portion in axial alignment within said passageway, said end portion having port means allowing removal of a screw contained within said end portion outwardly therefrom in a direction along the axis of said passageway, and said magazine including biasing means for urging screws within said magazine into said end portion thereof, said magazine having an outer wall defining a space within the magazine for containing screws and enclosing said space to an extent allowing grasping of said outer wall by a hand of an operator during use of the mechanism with a drill without contact between the operator's hand and screws within said space, said magazine serving as a handle during such use, and said skirt being positioned rearwardly of the front end of said passageway.

6. A kit according to claim 5 wherein said rod includes means for releasingly securing a drill bit to said front end thereof, the kit further including a plurality of drill bits for driving screws and a plurality of magazines for containing said screws.

7. A kit according to claim 5 wherein said magazine includes an elongated space for receipt of hollow cylinders each for receipt of a screw to be automatically fed, said cylinders being disposable within said space for forming a stack of screws maintained by said cylinders in parallel relationship, and pointing when disposed within said passageway towards the front end thereof, said screws having heads facing, when disposed within said passageway, towards the rear end thereof, and each said cylinder having an inner diameter less than the outer diameter of the screw received therein, whereby the head of each screw is disposed externally of an end of the cylinder in which it is received.

8. An automatic screw feeding mechanism for use with a drill, the mechanism comprising an elongated, hollow sleeve including a tubular wall defining an elongated passageway having front and rear ends and having a central axis, an elongated screw driving rod slidably and rotatably disposed within said passageway, said rod having a front end for operative engagement with a screw to be driven and a rear end for operative engagement with a drill, said tubular wall having an opening providing access to said passageway, and a magazine connected to said sleeve, said magazine comprising an outer wall defining a space for containing screws, said space communicating with said passageway, and means for biasing screws within said space into said passageway, said magazine being dependent from said sleeve and serving as a handle during use of the mechanism with a drill, said outer wall enclosing said space to an extent preventing contact between an operator's hand and screws within said space and said magazine being positioned rearwardly of the front end of said passageway.

9. The combination as claimed in claim 8, wherein the front end of said rod is extendable beyond the front end of said sleeve and said front end includes means for the insertion therein of a selected drill bit and for using different sized drill bits.

* * * * *